US005399005A

United States Patent [19]

Schafer

[11] Patent Number: 5,399,005

[45] Date of Patent: Mar. 21, 1995

[54] STACKABLE LOCKING DISPLAY AND DISPENSING STRUCTURE

[75] Inventor: Christopher E. Schafer, Adair, Iowa

[73] Assignee: Schafer Systems Inc., Adair, Iowa

[21] Appl. No.: 117,450

[22] Filed: Sep. 7, 1993

[51] Int. Cl.[6] ..... A47B 87/02

[52] U.S. Cl. ..... 312/107; 312/109; 312/111; 206/509; 242/615.2

[58] Field of Search ..... 312/34.4, 107, 109, 312/111; 206/509; 220/23.6; 226/196; 242/615.2

[56] References Cited

U.S. PATENT DOCUMENTS

| | | | |
|---|---|---|---|
| 1,602,383 | 10/1926 | Andersson | 312/107 |
| 2,375,438 | 5/1945 | Regenhardt | 312/107 |
| 2,386,343 | 10/1945 | Regenhardt | 312/111 |
| 2,573,602 | 10/1951 | Regenhardt | 312/111 |
| 2,593,998 | 4/1952 | Dupuis | 312/107 |
| 3,811,747 | 5/1974 | Levin | 206/509 |
| 4,518,134 | 5/1985 | Oishi et al. | 242/615.2 |
| 4,863,057 | 9/1989 | Hanifl et al. | 312/109 |
| 5,211,303 | 5/1993 | Mosior | 312/109 |
| 5,287,980 | 2/1994 | Saltz | 206/509 |

*Primary Examiner*—José V. Chen

*Assistant Examiner*—Rodney B. White

*Attorney, Agent, or Firm*—G. Brian Pingel

[57] ABSTRACT

A structure for the display and dispensing of tickets whereby top and bottom units are demountably attachable in a stackable arrangement. Each unit is of box-like configuration having a floor, a roof, a pair of sidewalls and an open rear end. A door is pivotally attached at a lower portion of the rear end and semi-permanently attachable in an opposite upper portion of the rear end of the unit to serve as a rear wall for the unit when in a closed position. The bottom unit has a front flange on the bottom portion of the front wall extending downward and rearward into a cavity in the top portion of the front wall to provide a forwardly extending lip portion engageable by the front flange of the top unit when the units are in a stacked relationship. The top unit also has a rear flange on its lower rear portion that extends through at least one opening in the roof of the bottom unit. The rear flange extends downwardly and rearwardly such that it may be engaged by a forwardly extending flange on the upper end of the door of the top unit when such door is in a closed position to lock the two units together in a semi-permanent relationship.

6 Claims, 5 Drawing Sheets 76
72
80
70
16
74
58b
78
14
46
60
58b
54b
16b
16a
66
62
56
64b
68
52
58a
48
54a
64a
50a
36b
44b
28
40b
42b
24
34
32
36a
44a
40a
18
42a
10
30
12
22
20

STACKABLE LOCKING DISPLAY AND DISPENSING STRUCTURE

BACKGROUND OF THE INVENTION

1. Field of the Invention

The present invention relates in general to a structure for the display and dispensing of tickets. More particularly, this invention relates to a unit which is demountably attachable to another unit in a stackable arrangement and rollers slidably mounted on slotted posts in an exit slot for dispensing the tickets.

2. Description of the Prior Art

While the use of stackable box-like structures for displaying and dispensing of tickets has been known for sometime, the most common and popular method for attaching such structures in a stackable arrangement has been either permanent or not lockable. Generally these methods require that the units be permanently attached such that they could not be taken apart, or that units were not lockable and could be removed by anyone, including unauthorized persons. Permanent mounting does not allow the flexibility for replacing individual units in the stackable arrangement, and nonlockable mounting presents a security problem.

While the use of rollers for dispensing tickets through an exit slot has been known for some time, the most common and popular method for mounting such rollers has been a single diameter throughbore on a post such that the clearance between the roller and the dispensing edge of the exit slot remains constant. The problem with this arrangement is that it does not allow for the varying thicknesses of tickets or dimensional variances inherent in an injection molding process. If the thickness of the ticket is less than the clearance between the roller and dispensing edge, then the ticket strip is not held in place so that the dispensed ticket may be properly separated from the strip. If the thickness of the ticket is greater than the clearance between the roller and dispensing edge, then either the tickets could not be dispensed through the slot or the tickets would be damaged by friction, especially those tickets with rub-off protective coatings.

A stacked display and dispenser structure is disclosed in U.S. Pat. No. 5,111,939. While the structure in this patent is stackably mountable, the only means for mounting two structures together is by fixing them together with some sort of adhesive or other external permanent means. Therefore, there is no means within the patent for demountably attaching the structures.

The present invention provides an integral engagement means for demountably attaching the structures in a stackable arrangement.

Ticket dispensers with tension exit means are shown in U.S. Pat. Nos. 978,052, 2,887,247, 4,738,384, and 5,100,038. While the devices disclosed in these patents utilize a tension dispensing means, all of them are more complex than the present invention, requiring springs and/or manual adjustment in order to properly function.

The present invention provides a simplified means for continual proper tension on the tickets as they are drawn through the exit means, with no need for springs or manual adjustment.

SUMMARY OF THE INVENTION

The present invention is a stackable display and dispensing structure for use with lottery-type tickets. The structure generally comprises an engagement means for demountably attaching the structures in a stackable arrangement. This engagement means is comprised of a front flange and corresponding cavity, and a rear flange and corresponding recess such that the rear flange is engaged by a rear door when it is in a closed position.

The present invention also includes an exit means with rollers mounted on slotted posts on either side of the exit means such that the tickets are dispensed between each roller and the rearwardly extending cutting edge. Each roller has a throughbore with two diameters for mounting, the first portion having a diameter in close tolerance with the mounting post, and the second portion having a diameter slightly larger than the first diameter. This larger diameter creates a fulcrum effect on each roller toward the midpoint of the roller throughbore, increasing the resiliency of each roller to allow for the proper dispensing of tickets of various thicknesses.

DETAILED DESCRIPTION OF THE PREFERRED EMBODIMENT

Figure 1:
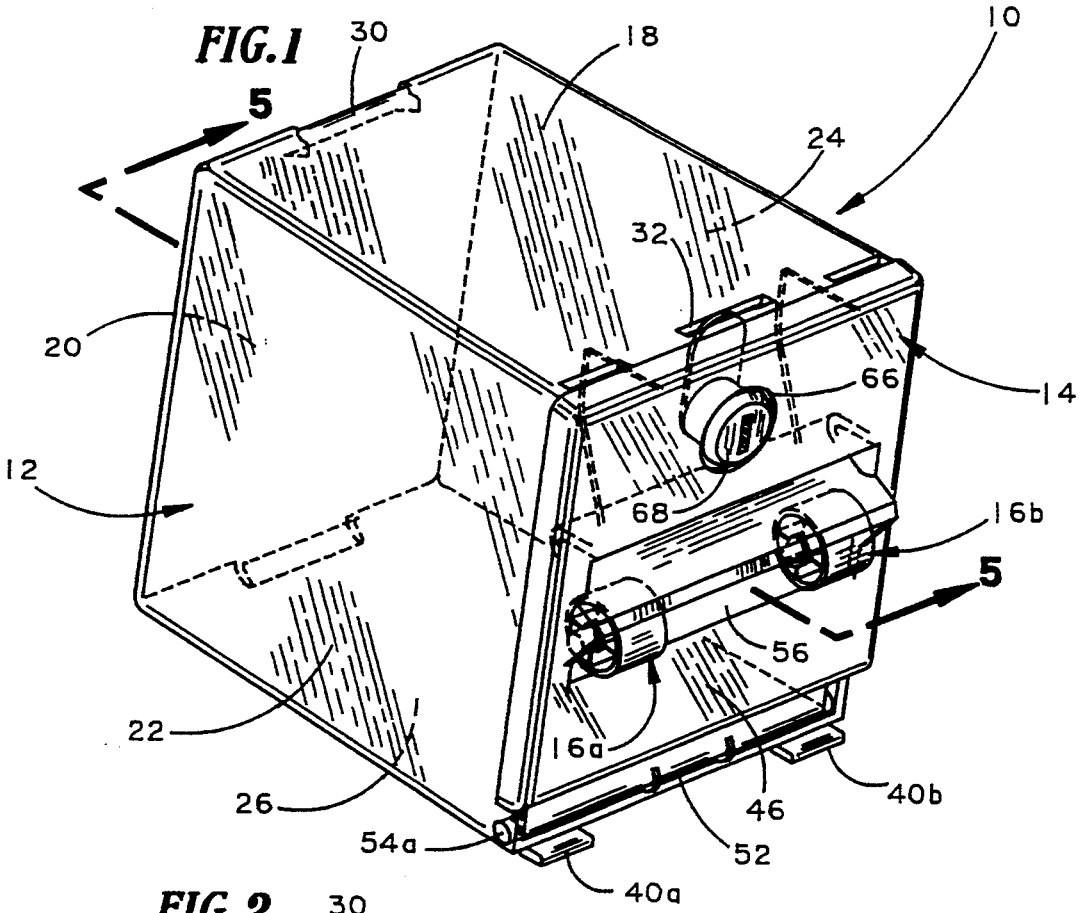
FIG. 1 is a rear perspective view of a preferred embodiment of a base unit of the stackable locking display and dispensing structure of this invention.

With reference to the drawings, a base unit of the stackable locking display and dispensing structure of this invention is indicated generally as 10 in FIG. 1, and includes a box unit 12, a door 14, and a pair of rollers **16*a* and 16*b*. A top unit 10' is shown in a stacked relationship with the base unit 10 in FIGS. 9, 10, 11, and is identical in all respects to the base unit 10**, and will, therefore, be identified with like numbers primed.

Figures 3, 12:
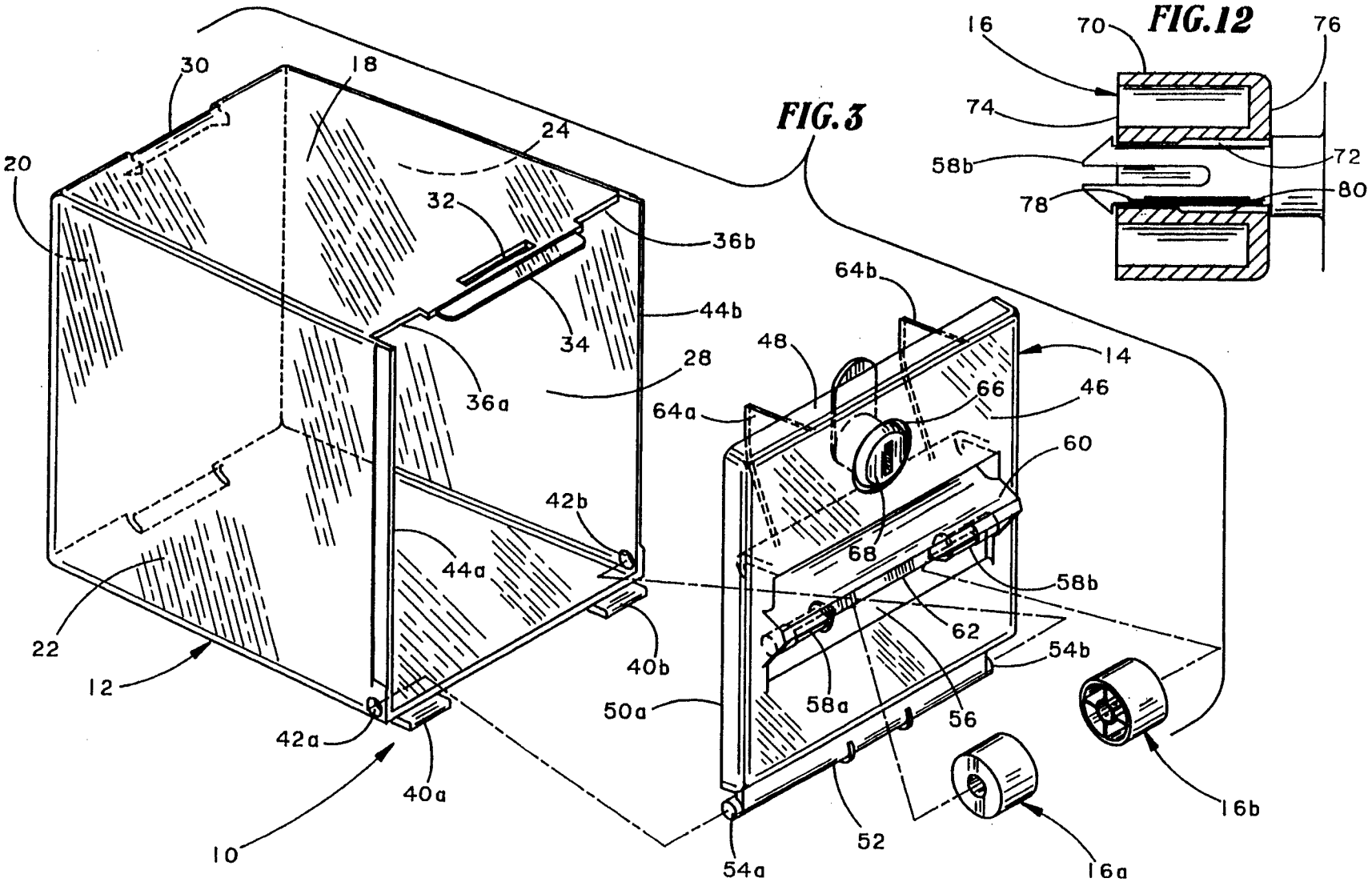
FIG. 3 is an exploded rear perspective view of the preferred embodiment of FIG. 1 showing the door, and rollers removed for clarity.
FIG. 12 is an enlarged cross-sectional view of a roller shown slidably mounted to a slotted post of the preferred embodiment of FIG. 1.

The box unit 12 of the base unit 10 has a top surface 18, a front wall 20, a pair of opposite sidewalls 22 and 24, and a bottom surface 26. As best shown in FIG. 3 a rear opening 28 allows access to the inside of the box unit 12.

Figure 5:
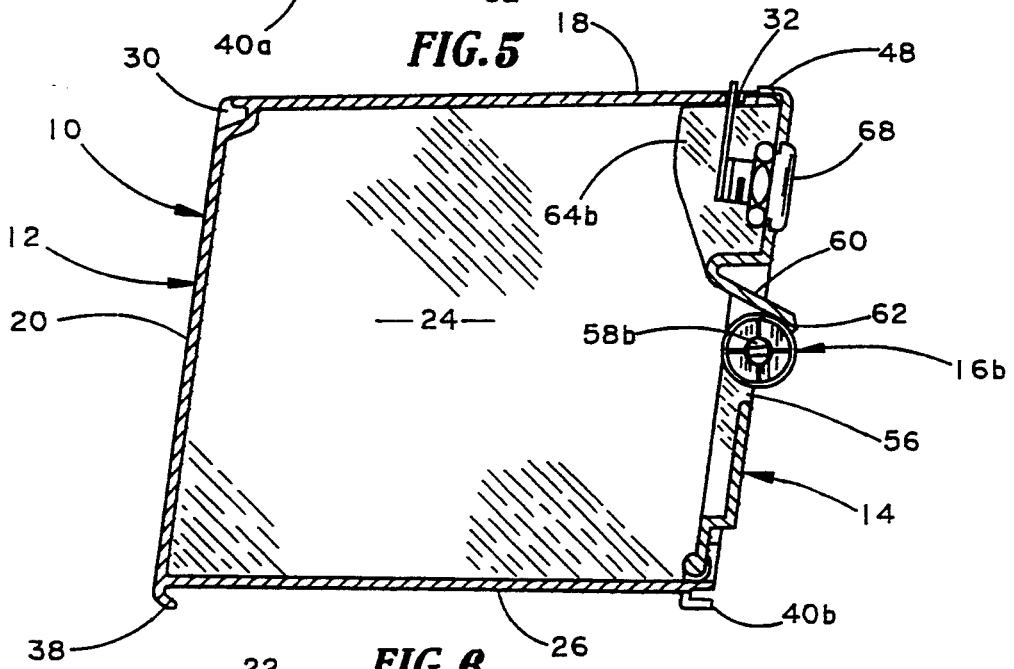
FIG. 5 is a side cross-sectional view of the preferred embodiment of FIG. 1 taken along line 5—5 of FIG. 1.
Figure 6:
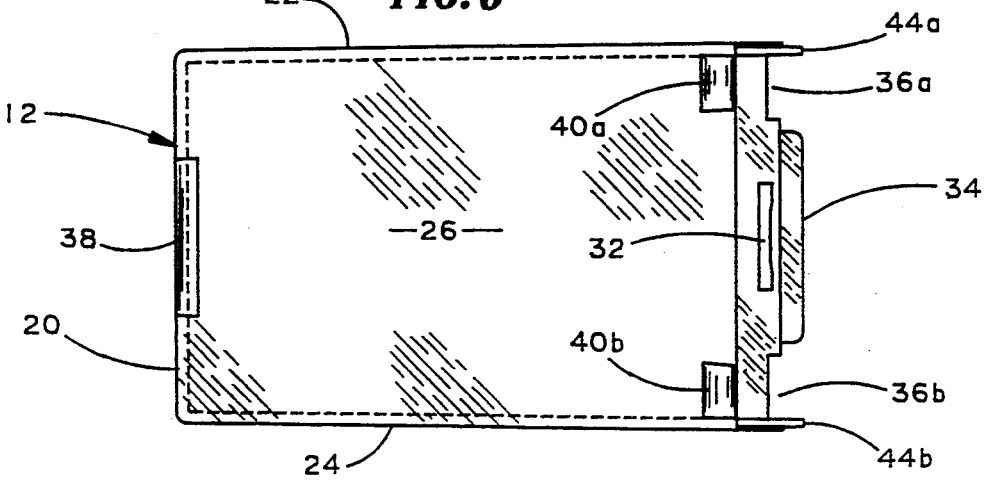
FIG. 6 is a bottom view of the preferred embodiment of FIG. 1 with the door removed.
Figure 8:
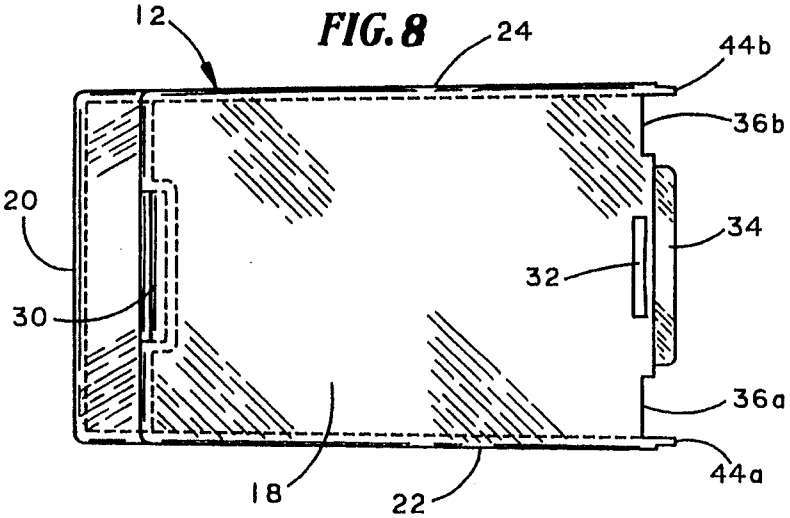
FIG. 8 is a top view of the preferred embodiment of FIG. 1 with the door removed.
Figure 10:
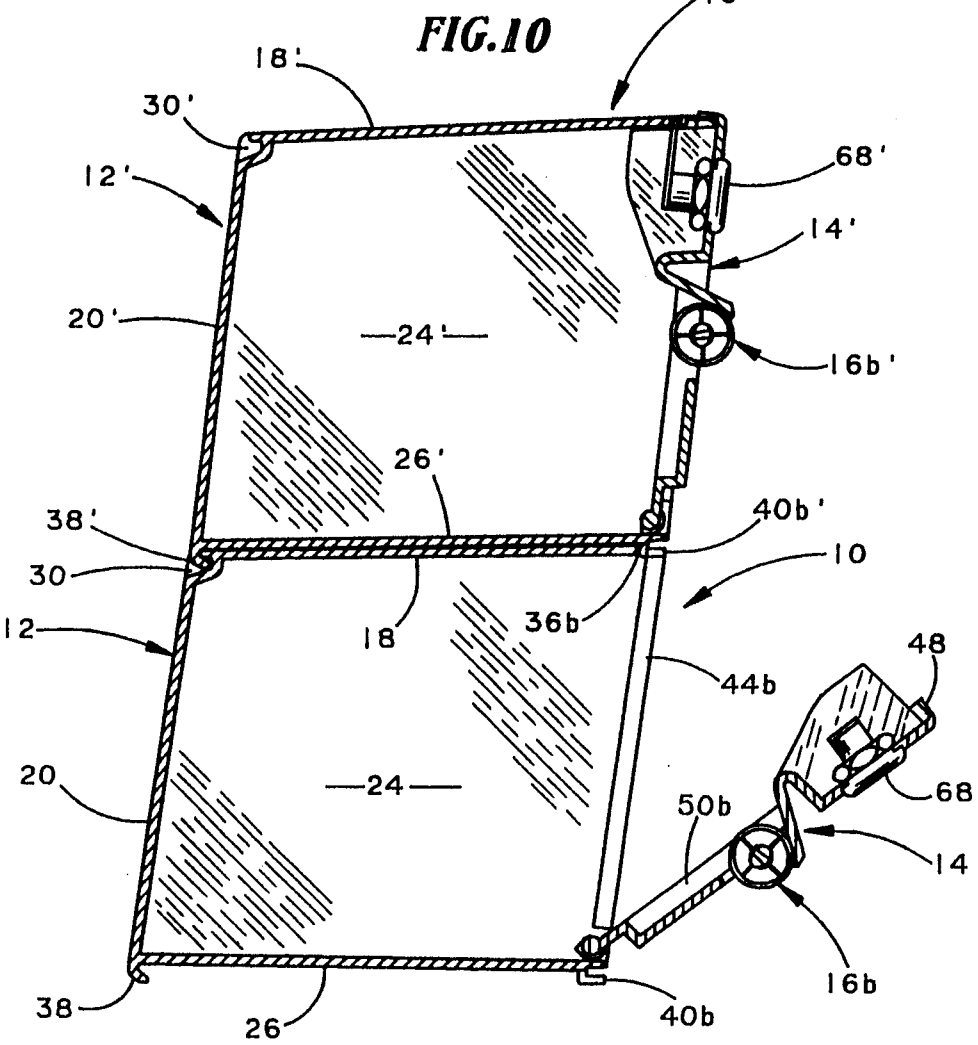
FIG. 10 is shown similar to FIG. 9, but with the top unit fully engaged with the base unit of the preferred embodiment of FIG. 1, and the door of the base unit still in an open position.

Referring now to FIGS. 3, 5 and 8, the top surface 18 of the box unit 12 has at its front edge, a recessed pocket 30, and at its rear edge, a slot 32, an extended tab 34, and a pair of notches 36*a* and 36*b*. The bottom surface 26 of the box unit 12, as best shown in FIGS. 3, 5, and 6, has at its front edge, a front flange 38, and at its rear edge, a pair of rear flanges 40*a* and 40*b*. The recessed pocket 30 on the top surface 18 of the base unit 10 is formed such that it will receive the front flange 38′ of the top unit 10′. Also, the rear notches 36*a*, and 36*b* on the top surface 18 of the base unit 10 are positioned and sized to accept the rear flanges 40*a*′ and 40*b*′ of the top unit 10′ (FIG. 10).

As best shown in FIG. 3, the sidewalls 22 and 24 are formed generally in the shape of a parallelogram, and, therefore, give the box unit 12 a rearward slanted shape. Also formed in the bottom rear corner of the sidewalls 22 and 24 are holes 42*a*, and 42*b*. A pair of vertical rear edges 44*a* and 44*b* of the sidewalls 22, 24 respectively are somewhat thinner than the typical wall thickness of the sidewalls 22 and 24 for receivably engaging the door 14.

Figure 4:
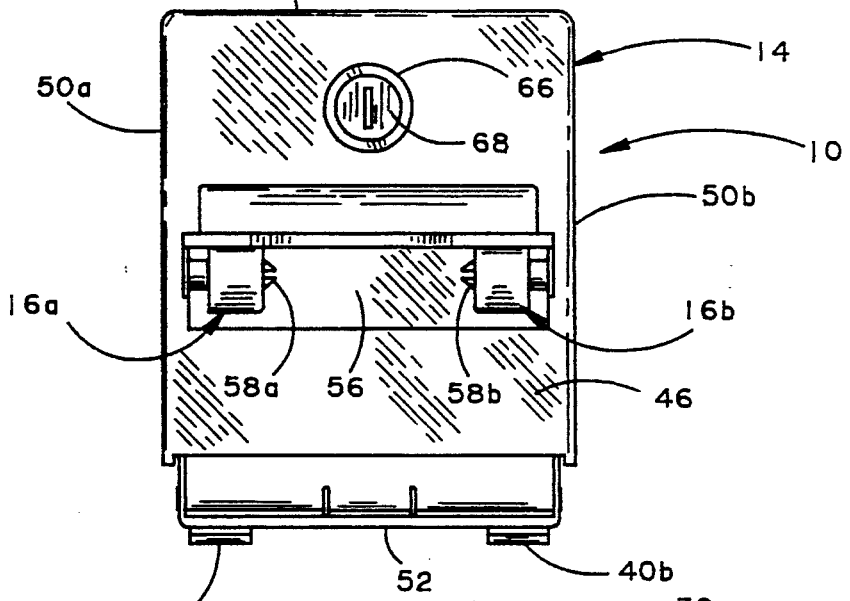
FIG. 4 is a rear elevation view of the preferred embodiment of FIG. 1.

The door 14, as best shown in FIGS. 3 and 4 has a vertical face 46, a horizontal top flange 48, and a pair of vertical side flanges 50*a* and 50*b*. A bottom edge 52 of the door 14, is generally cylindrical in shape and has a pair of stub shafts 54*a*, and 54*b* at opposite ends. The stub shafts 54*a* and 54*b* are designed to be receivably journaled into the holes 42*a* and 42*b* of the sidewalls 22 and 24 of the box unit 12 and, therefore, be pivotally attached. When in the closed position, as shown in FIGS. 1 and 5, the horizontal top flange 48, and the vertical side flanges 50*a* and 50*b*, of the door 14 encompass, and provide a close fit with the extended tab 34 and the rear flanges 40*a* and 40*b*, respectively of the box unit 12.

The vertical face 46, of the door 14 is provided with a horizontal opening 56. The opening 56 extends almost the full width of the door 14, and is provided at each end with a pair of slotted posts 58*a* and 58*b* for receiving a pair of the rollers 16*a* and 16*b* respectively (FIGS. 3, 4, and 5). As best shown in FIG. 5, the upper surface of the opening 56 is formed by a sloped member 60 that terminates in a sharp bevelled edge 62. A pair of support members 64*a* and 64*b* protrude from the inner surface of the door 14, and provide support for the top surface 18 of the box unit 12 when the door 14 is closed.

Also provided in the vertical face 46 of the door 14 is a hole 66 for installation of a commercially available key actuated cam lock assembly 68. When the door 14 is closed, as shown in FIGS. 1, 2 and 5, the key actuated cam lock assembly 68 can be rotated so that the cam engages the slot 32 in the top 18 of the box unit 12 and the door 14 is thus secured from opening.

The pair of rollers 16*a* and 16*b*, are identical, and, therefore, only one will be described in detail. As best shown in FIG. 12, the roller 16 has an outer surface 70, a throughbore 72, an outer end 74 and an inner end 76. The throughbore 72 is comprised of two different sections, a smaller diameter section 78, and a larger diameter section 80. The smaller diameter section 78 begins at the outer end 74, and extends approximately one-third the length of the throughbore 72. The larger diameter section 80 begins at the inner end 76, and extends approximately two-thirds the length of the throughbore 72. As shown in FIG. 5, the smaller diameter section 78 of the throughbore 72 has a relatively close fit with the slotted post 58, while the larger diameter section 80 of the throughbore 72 has a relatively loose fit with the slotted post 58. The fit of, the roller 16 to the slotted post 58 allows the roller to rock or tilt on the slotted post 58 for a purpose to be described later.

Figure 2:
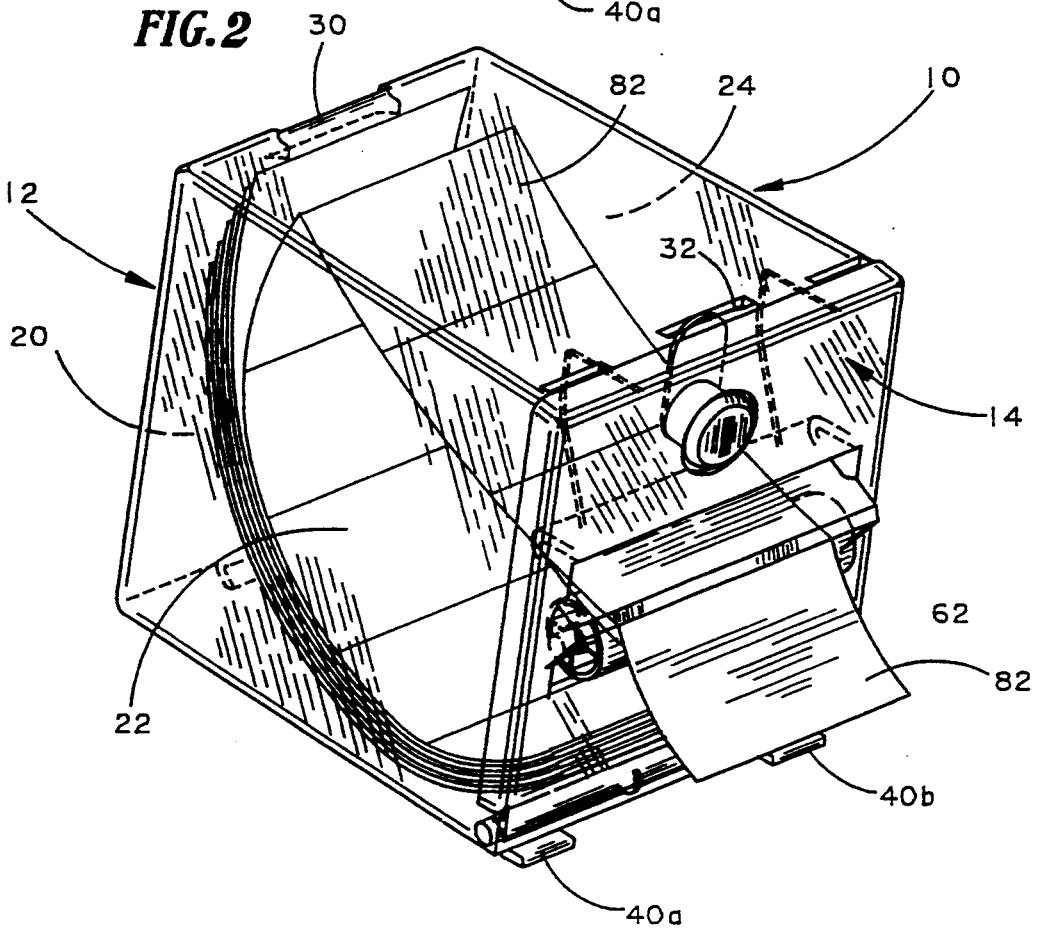
FIG. 2 is a similar view of the preferred embodiment of FIG. 1, with the base unit shown containing lottery tickets for dispensing.

The stackable locking display and dispensing structure units are typically used for dispensing lottery tickets 82, as shown in FIG. 2. The base unit 10 of the stackable locking display and dispensing structure may be used alone, but it is often desirable, and necessary, that one or more top units 10′ be used in conjunction with the base unit 10. This use of multiple units allows for more capacity, and the dispensing of two or more different types of tickets. In the preferred embodiment of this invention, all components are molded from a clear plastic such as acrylic, or polycarbonate. This allows the clerk to monitor the remaining supply of tickets.

Figure 9:
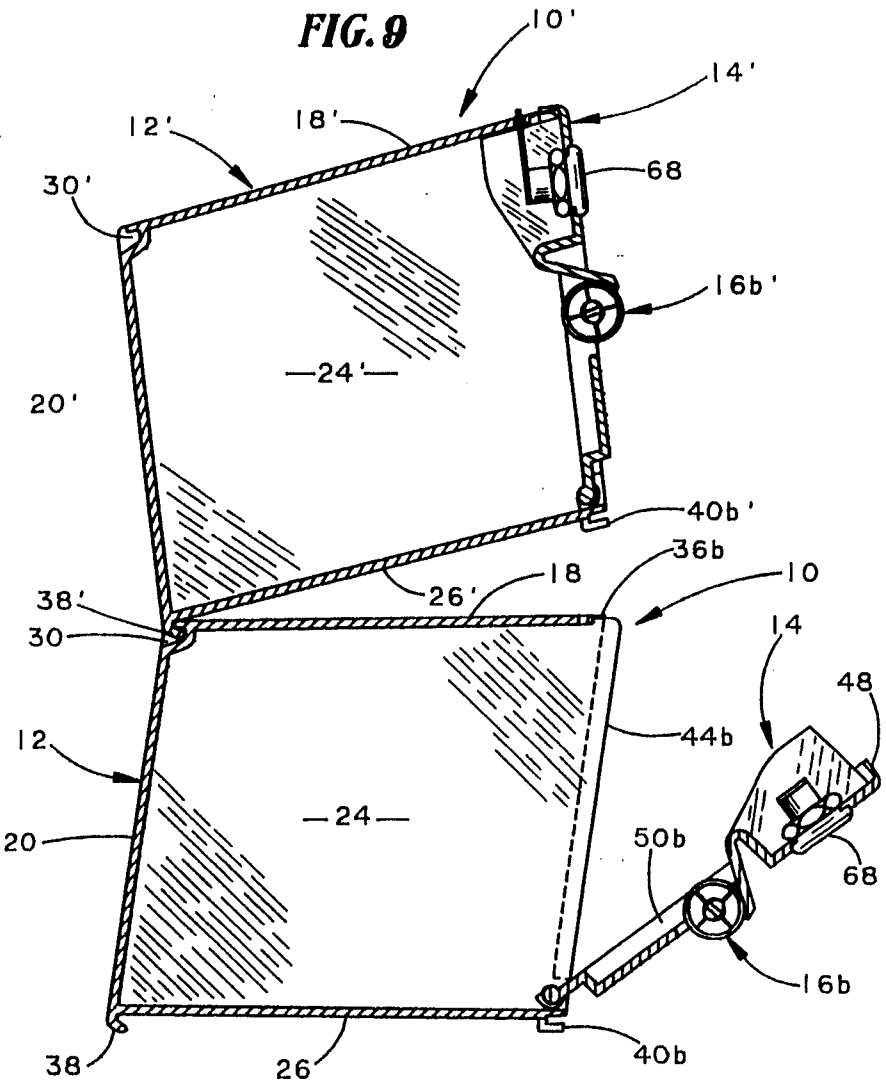
FIG. 9 is a side cross-sectional view of the preferred embodiment of FIG. 1 in a partially engaged assembly relationship with an identical top unit, and the door of the base unit in an open position.
Figure 7:
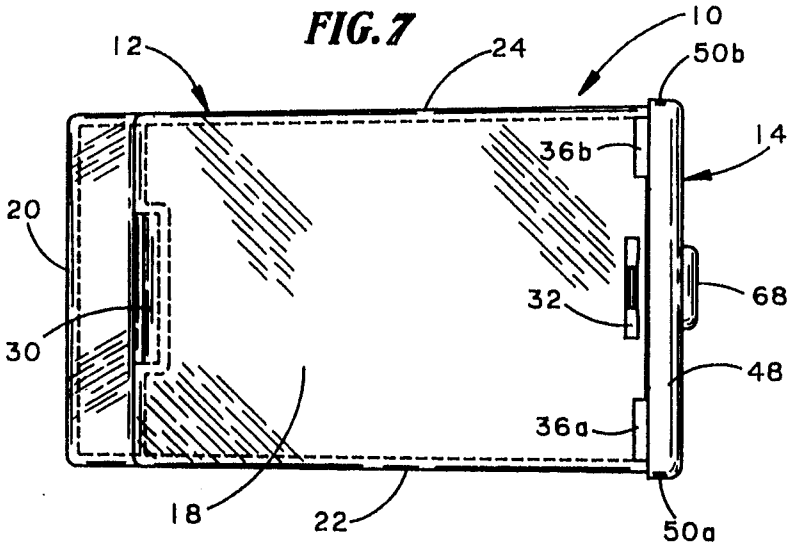
FIG. 7 is a top view of the preferred embodiment of FIG. 1 with the door installed and closed.
Figure 11:
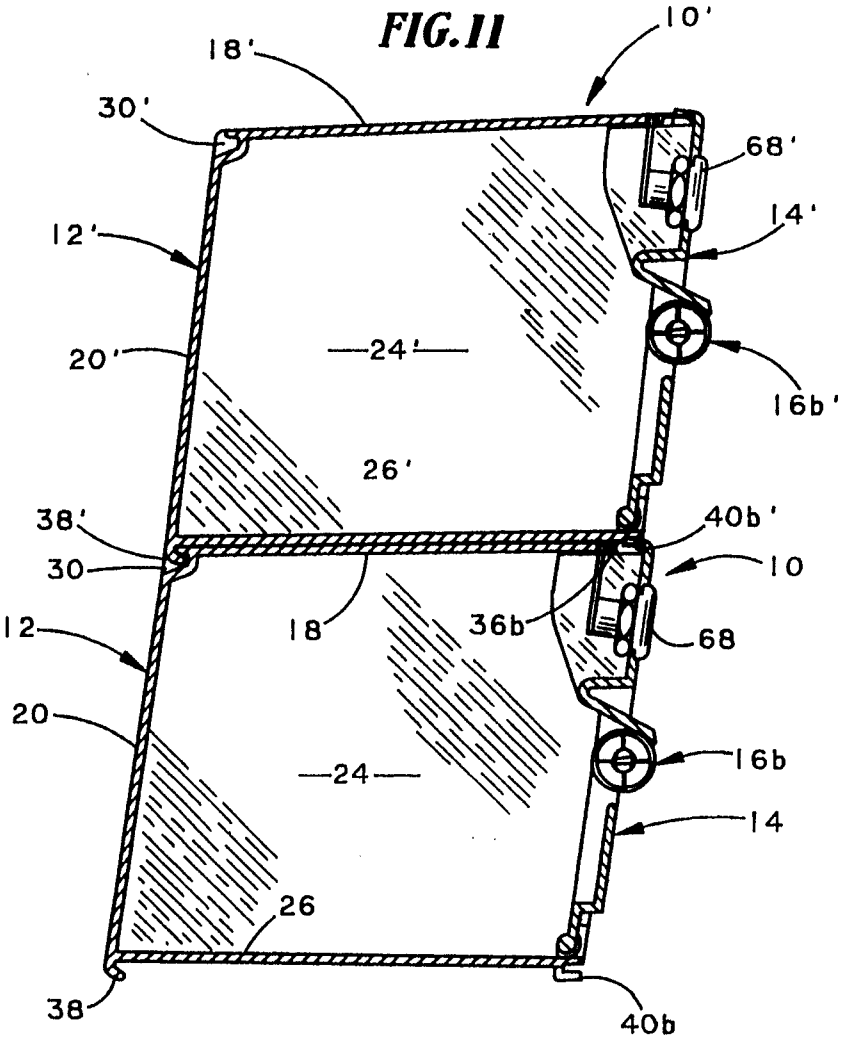
FIG. 11 is shown similar to FIG. 10, but with the door of the base unit of the preferred embodiment of FIG. 1 closed to secure the top unit against removal.

FIGS. 9, 10 and 11, show how multiple units 10 and 10′ are stacked and locked together. The base unit 10 is secured to a mounting surface (not shown), and the door 14 is opened. At this time lottery tickets 82 may be loaded into the base unit 10, threaded through the opening 56 in the door 14, and over the rollers 16. The top unit 10′ is then positioned as shown in FIG. 9 with the front flange 38′ of the top unit 10′ engaged in the recessed pocket 30 of the base unit 10. The top unit 10′ is then rotated onto the base unit 10 so that the rear flanges 40*a*′ and 40*b*′ of the top unit 10′ enter the notches 36*a* and 36*b*, respectively, of the base unit 10 (FIG. 10). The door 14 of the base unit 10 is then closed and locked so that the horizontal top flange 48, of the door 14 captures the rear flanges 40*a*′ and 40*b*′ of the top unit 10′ (FIG. 11). Thus it can be seen that by closing and locking the door 14 of the base unit 10, the top unit 10′ is now secured against removal. It can also be seen that one, or more additional top units 10′ can be stacked on present top unit 10′ and secured in a similar manner.

The rearward slanted shape of the units 10 and 10′, produce a multiple stack of units that is slanted towards the sales clerk, and thus make it not so difficult to reach the lottery tickets 82 as were the stack to be vertical.

As described earlier, the rollers 16*a* and 16*b* are free to rock on the slotted mounting posts 58*a* and 58*b*. The purpose of such movement is to allow for the dispensing of varying thicknesses of lottery tickets 82 and dimensional variances in the molding process, while, at the same time, apply an even, but not excessive pressure spaced a short distance inward of the sharp cutting edge 62, of the sloped member 60. Any such excessive pressure can remove the coating on the lottery tickets 82 designed to hide the numbers, thus rendering them void. The gap between each roller 16, and the slotted mounting posts 58 from the larger diameter 80 creates a fulcrum effect on each roller 16 toward the midpoint of the roller throughbore, increasing the resiliency of each roller 16 and provides for a more even distribution of pressures on the ticket to allow for the proper dispensing of lottery tickets 82 of various thicknesses.

Although the invention has been described with respect to a preferred embodiment thereof, it is to be understood that it is not to be so limited since changes and modifications can be made therein which are within the full intended scope of this invention as defined by the appended claims.

I claim:

1. A stackable locking display and dispensing structure comprising:

(a) a base unit of box-like configuration having a floor, a roof, a pair of sidewalls and an open rear end, said roof having a rear edge with at least one opening;

(b) a base unit door pivotally attached at a lower portion of the rear end of said base unit and semi-permanently attachable at an opposite upper portion of the rear end of said base unit to serve as a rear wall for said base unit when in a closed position;

(c) a top unit of box-like configuration having a floor, a roof, a pair of sidewalls, a front end and an open rear end identical in shape and size to the base unit;

(d) a top unit door pivotally attached at a lower portion of the rear end of said top unit and semi-permanently attachable at an opposite upper portion of the rear end of said top unit to serve as a rear wall for said top unit when in a closed position;

(e) means for demountably attaching said top unit in association with the base unit in a stackable arrangement, said means including:

(1) first engagement means on the lower front portion of said top unit and an upper portion of said front wall of said base unit that coact to limit the movement of said units with respect to one another;

(2) second engagement means on the lower rear portion of said top unit and the upper end of said base unit door that coact when said base unit door is in a closed position to lock said units together semi-permanently; and (f) said second engagement means including:

(1) a rear flange on the lower rear portion of said top unit that is positioned through said least one opening in the roof of said base unit and having a lower end portion extending outwardly to the rear of said top unit; and (2) a forwardly extending flange on the upper end of said base unit door for engaging and overlying the lower end portion of the rear flange of said top unit when said base unit door is in a closed position.

2. A display and dispensing structure according to claim 1 wherein said first engagement means includes:

(a) a front flange on one of the top unit and bottom unit and extending toward the other of said units; and (b) a cavity in the front wall of one of said base unit or top unit to provide a forwardly extending lip portion engageable by said front flange.

3. A display and dispensing structure according to claim 1 that further includes:

(a) said doors of each of said base unit and said top unit have a horizontally aligned exit means having a top edge extending outwardly from an outer surface of said doors and opposite sidewall whereby tickets may be dispensed from said structure;

(b) two slotted posts, each fixedly attached to one of the sidewalls of the exit means in a horizontal position extending inwardly toward the opposite sidewall; and (c) a roller slidably mounted on each of the slotted posts, said roller having an axial throughbore with two portions, a first portion of the bore length having a diameter in close tolerance with the slotted post and a second portion of the bore length having a diameter somewhat larger than the first diameter to increase the resiliency of said roller with respect to said exit means to avoid damage to tickets dispensed through said exit means.

4. A stackable locking display and dispensing structure comprising:

(a) a base unit of box-like configuration having a floor, a roof, a pair of sidewalls, a front end and an open rear end, said roof having a rear edge with at least one recessed portion;

(b) a base unit door pivotally attached at a lower portion of the rear end of said base unit and semi-permanently attached at an opposite upper portion of the rear end of said base unit to serve as a rear wall for said base unit when in a closed position; said door having an upper end with a frontwardly extending flange;

(c) an upper portion of said front wall having a cavity to provide a frontwardly extending lip portion;

(d) a top unit of box-like configuration having a floor, a roof, a pair of sidewalls, a front end and an open rear end identical in shape and size to the base unit;

(e) a top unit door pivotally attached at a lower portion of the rear end of said top unit and semi-permanently attached at an opposite upper portion of the rear end of said top unit to serve as a rear wall for said top unit when in a closed position; said door having an upper end with a frontwardly extending flange;

(f) a front flange extending downwardly from the lower front portion of said top unit;

(g) at least one rear flange having a lower end portion extending outwardly from the lower rear portion of said top unit; and (h) said top and base units are demountably attachable by placement of the top unit in association with the base unit so that said front flange of the top unit fits into said cavity of said base unit to engage said cavity lip, and said rear flange of said top unit extends through the recessed portion of said base unit roof so that when said base unit door is in a closed position, the flange of said door overlaps the outwardly extending end of said top unit rear flange and thereby semi-permanently secures said units together.

5. A structure according to claim 4, in which additional units identical to the top unit may be joined together stackably, each of said additional units being mounted atop the previous unit via the floor of the additional unit and the roof of the previous unit by way of said front and rear flanges.

6. A structure according to claim 4 that further includes:

(a) said doors of each of said base unit and said top unit have a horizontally aligned exit means having a top edge extending outwardly from an outer surface of said doors;

(b) two slotted posts, each fixedly attached to one of the sidewalls of said exit means slot in a horizontal position extending inwardly toward the other side; and (c) a roller slidably mounted on each of the slotted posts, said roller having an axial throughbore with a first portion of the length of the bore having a diameter in close tolerance with the slotted post and a second portion of the length of the bore having a diameter somewhat larger than the first diameter to increase the resiliency of said roller.

* * * * *